US005595509A

United States Patent [19]

Fry et al.

[11] Patent Number: 5,595,509

[45] Date of Patent: Jan. 21, 1997

[54] ELECTRICAL CONNECTOR WITH TERMINAL POSITION ASSURANCE SYSTEM

[75] Inventors: Rupert J. Fry, Mt. Prospect; Adam F. Guzik, Darien; John S. Luthy, Naperville, all of Ill.

[73] Assignee: Molex Incorporated, Lisle, Ill.

[21] Appl. No.: 514,645

[22] Filed: Aug. 14, 1995

[51] Int. Cl.[6] ..... H01R 13/436

[52] U.S. Cl. ..... 439/752; 439/595

[58] Field of Search ..... 439/752, 595

[56] References Cited

U.S. PATENT DOCUMENTS

| | | | |
|---|---|---|---|
| 4,804,341 | 2/1989 | Kato et al. | 439/752 |
| 4,915,654 | 4/1990 | Zinn | 439/595 |
| 5,044,991 | 9/1991 | Colleran et al. | 439/595 |
| 5,160,283 | 10/1992 | Fry et al. | 439/752 |
| 5,167,534 | 12/1992 | Ohsumi | 439/595 |
| 5,281,168 | 1/1994 | Krehbiel et al. | 439/595 |
| 5,299,958 | 4/1994 | Ohsumi | 439/752 |
| 5,326,287 | 7/1994 | Hamakita et al. | 439/752 |
| 5,358,427 | 10/1994 | Miwa | 439/595 |

FOREIGN PATENT DOCUMENTS

| | | | |
|---|---|---|---|
| 0606903 | 1/1994 | European Pat. Off. | H01R 13/436 |
| 0624922 | 4/1994 | European Pat. Off. | H01R 13/436 |
| 1294382 | 11/1989 | Japan | H01R 13/639 |

OTHER PUBLICATIONS

Full Line Catalog No. 910 Published Spring 1991 Cover Page and p. 9K.

*Primary Examiner*—P. Austin Bradley
*Assistant Examiner*—T. C. Patel
*Attorney, Agent, or Firm*—Stephen Z. Weiss

[57] ABSTRACT

An electrical connector assembly includes an elongated housing having a plurality of terminal-receiving cavities extending transversely of the housing. The cavities are arranged in at least two rows lengthwise of the housing, and two rows of terminal-protective silos project forwardly of a front mating face of the housing in alignment with the cavities. Two generally parallel channels run longitudinally of the housing and intersect the two rows of cavities. A longitudinal solid wall portion of the front mating face of the housing extends lengthwise between the two rows of forwardly projecting silos. A plurality of slits are formed in the front mating face between adjacent silos in alignment with transverse walls between the cavities, the slits extending rearwardly to the channels. A plurality of terminals are adapted to be inserted into the cavities to fully inserted positions in the forwardly projecting silos. The terminals have portions adapted to block the channels if the terminals are not in their respective fully inserted positions. An elongated bifurcated terminal position assurance device includes a pair of longitudinal legs insertable into the two channels unless one of the channels is blocked by a portion of one of the terminals in either row thereof.

3 Claims, 5 Drawing Sheets

ELECTRICAL CONNECTOR WITH TERMINAL POSITION ASSURANCE SYSTEM

FIELD OF THE INVENTION

This invention generally relates to the art of electrical connectors and, particularly, to an electrical connector assembly which includes a terminal position assurance system that allows the connector housing to be molded with simple front and rear dies while providing the housing with sufficient reinforcing walls.

BACKGROUND OF THE INVENTION

A common type of electrical connector includes a dielectric housing having a plurality of terminal-receiving cavities within which are mounted a plurality of terminals. The terminals may be stamped and formed metal components and include a mating end for mating with terminals of a complementary electrical connector assembly, along with terminating ends for termination to a plurality of electrical cables, wires or to circuitry on a printed circuit board, for instance. The terminals must be properly positioned within their respective housing cavities for proper mating with the terminals of the complementary connector assembly.

Improper installation of electrical connectors has long been a problem in mating connector assemblies. The mating assemblies may perform quite adequately under normal circumstances, but open circuits can occur when the terminals are not properly positioned within the dielectric housings of the connector assemblies or when the assemblies are not properly mated. In addition to open circuits, terminal retention also is important because of problems that can be encountered due to continuous mating and unmating of the connectors over the life of the assemblies. In addition, use of the connectors in vibration environments can cause the terminals to become loosened and improperly positioned. Improper retention of the terminals can result in unstable electrical interconnections.

Various designs have been used to improve the retention of terminals within electrical connector housings and to improve the mating integrity of the connector assemblies themselves. For example, regarding the mating connectors, plastic terminal latches integral with the connector housing often are used to enhance the mating integrity between the connectors. However, regardless of the integrity between the connector housings themselves, if the terminals are improperly positioned within each housing, open circuits, terminal damage and other problems can occur even though the connector housings are properly mated. Therefore, various devices have been designed to protect against improperly positioned terminals and, in fact, to prevent the connector assemblies from mating unless all of the terminals therewithin are properly positioned. Such devices commonly have been called "terminal position assurance" (TPA) devices.

For instance, a known terminal position assurance system in an elongated connector utilizes an elongated terminal position assurance (TPA) device extendable longitudinally through the housing. If any one of a plurality of terminals is not in its fully inserted position, movement of the TPA device is blocked and it cannot be extended longitudinally through the housing, thereby indicating terminal positioning problems.

One type of electrical connector which has presented problems in utilizing elongated TPA devices as described immediately above, is a connector which has terminal-protective silos projecting forwardly of a front mating face of the connector housing. The silos are arranged in at least two rows lengthwise of the elongated housing. A singular TPA device is extendable longitudinally through the housing in operative association with all of the terminals in the silos in both rows. The problem with this type of connector is its manufacturability. Specifically, the connector housing generally is open at both the front and back sides of the housing. Therefore, a pair of dies for molding the front and back sides, along with a slide die which slides perpendicularly to the front and back dies, are required to mold the connector housing. When such a slide die is used, the construction of the mold becomes more complex and thus expensive, and molding also takes a longer time. If the slide die is eliminated, the channel for receiving the elongated TPA device must be molded from the rear and front sides of the housing, leaving open areas between the forwardly projecting, terminal-protective silos. This weakens the housing between the silos, and the housing has a tendency to break when transverse forces are exerted on the silos.

The present invention is directed to solving the above myriad of problems by providing an electrical connector having forwardly projecting terminal-protective silos, with the connector housing capable of being molded by only a pair of front and rear dies, without leaving open areas between the silos which would weaken the housing reducing the strength of the silos.

SUMMARY OF THE INVENTION

An object, therefore, of the invention is to provide a new and improved electrical connector assembly which includes a terminal position assurance system.

Another object of the invention is to provide such an electrical connector having forwardly projecting terminal-protective silos, with the connector housing being moldable by a pair of front and rear dies, with sufficient housing support between the silos.

In the exemplary embodiment of the invention, the electrical connector includes an elongated housing having a front mating face and a rear terminal-insertion face, with a plurality of terminal-receiving cavities extending transversely of the housing between the faces. The cavities are arranged in two rows lengthwise of the housing. Two rows of terminal-protective silos project forwardly of the front mating face in alignment with the cavities. Transverse walls separate the cavities in each row, with the walls extending in a direction between the front and rear faces of the housing. Two generally parallel channels run longitudinally of the housing intersecting the two rows of cavities. A longitudinal solid or uninterrupted wall portion of the front mating face of the housing extends lengthwise between the two rows of forwardly projecting silos. A plurality of slits in the front mating face are formed between adjacent silos in alignment with the transverse walls and extending rearwardly to the channels.

A plurality of terminals are adapted to be inserted into the cavities to fully inserted positions in the forwardly projections silos. The terminals have portions adapted to block the channels if the terminals are not in their respective fully inserted positions.

An elongated bifurcated terminal position assurance (TPA) device includes a pair of longitudinal legs insertable into the two channels unless one of the channels is blocked by a portion of one of the terminals in either row thereof. Therefore, if the TPA device cannot be inserted into the channels, terminal positioning problems are indicated. It also is contemplated that the TPA device act as a secondary locking device for the fully inserted terminals.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
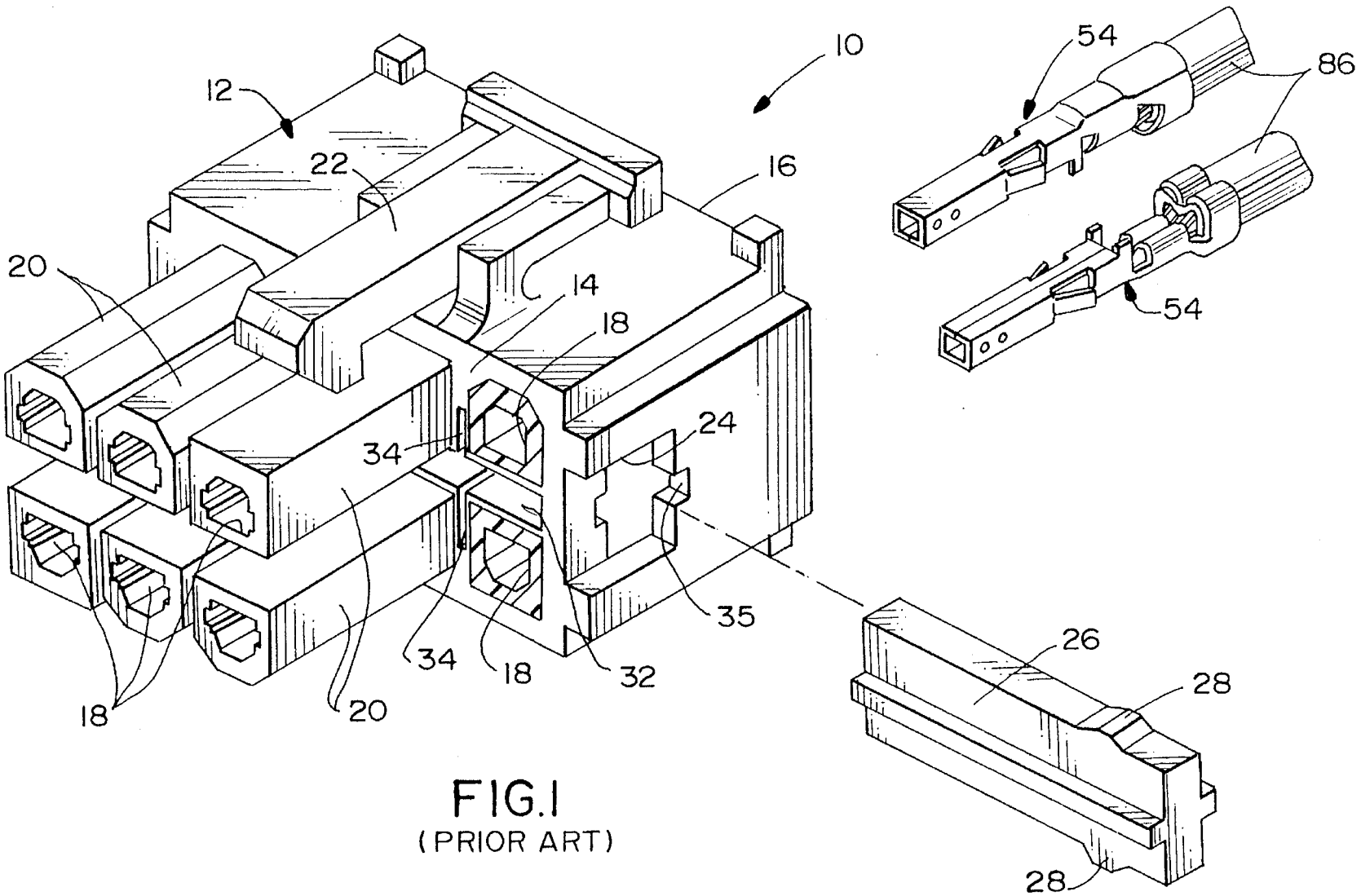
FIG. 1 (PRIOR ART)
FIG. 1 is an exploded perspective view, partially cut away, of an electrical connector embodying a terminal position assurance system according to the prior art.
Figure 2:
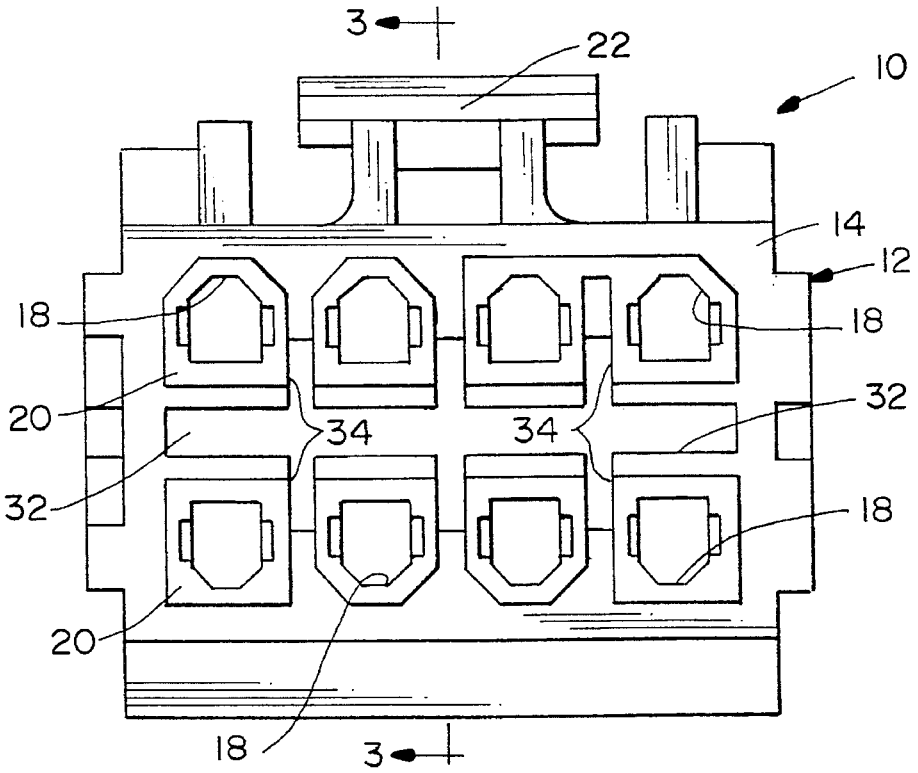
FIG.2 (PRIOR ART)
FIG. 2 is a front elevational view of the prior art connector of FIG. 1.
Figure 3:
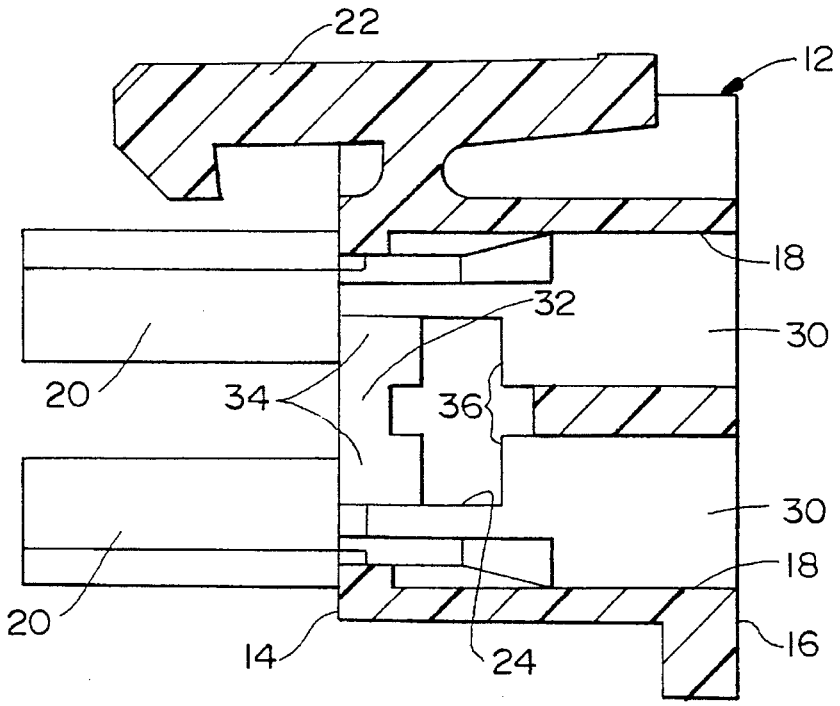
FIG.3 (PRIOR ART)
FIG. 3 is a vertical section taken generally along line 3—3 of FIG. 2.
Figure 4:
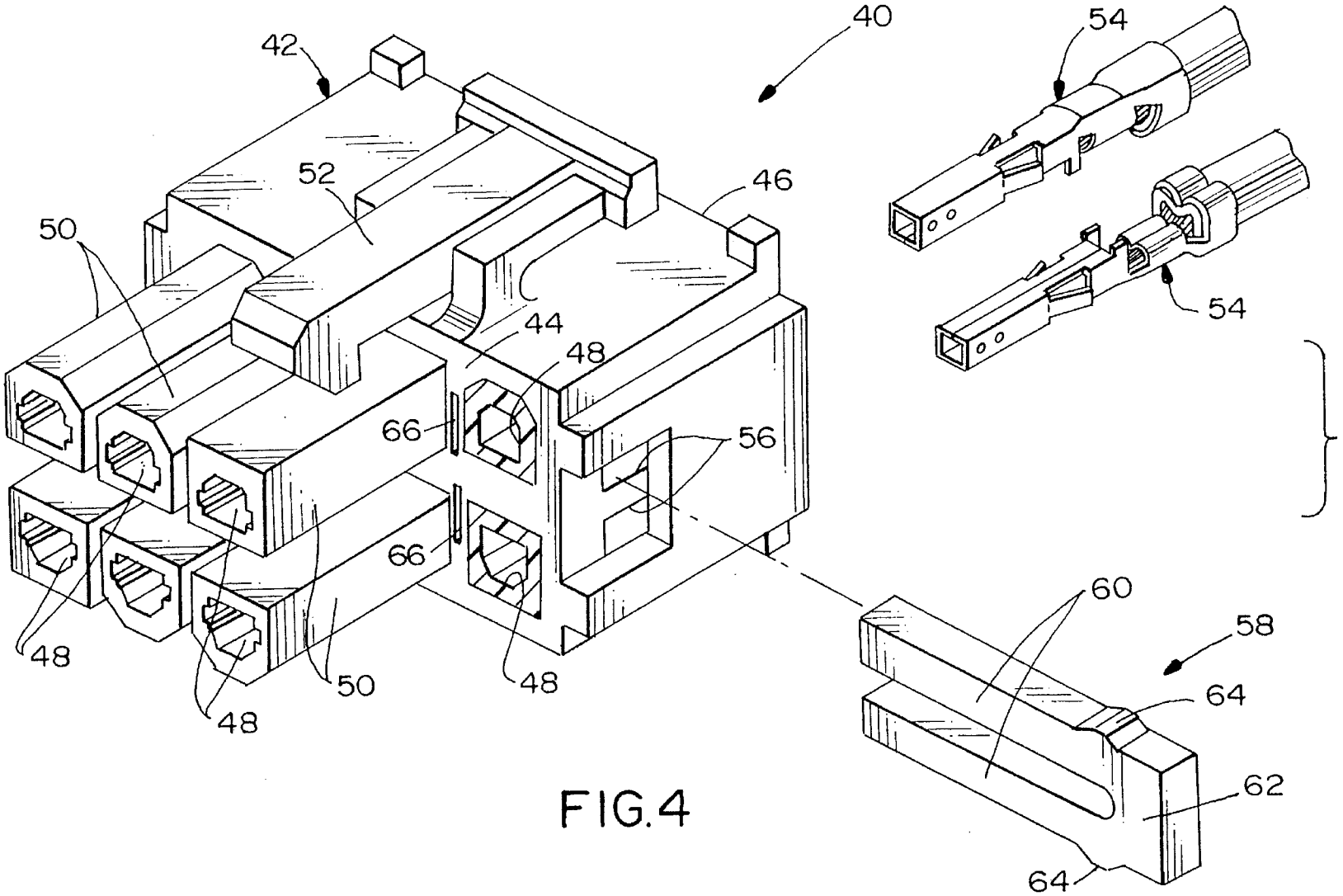
FIG. 4 is an exploded perspective view, partially cut away, of an electrical connector embodying the terminal position assurance system of the invention.
Figure 5:
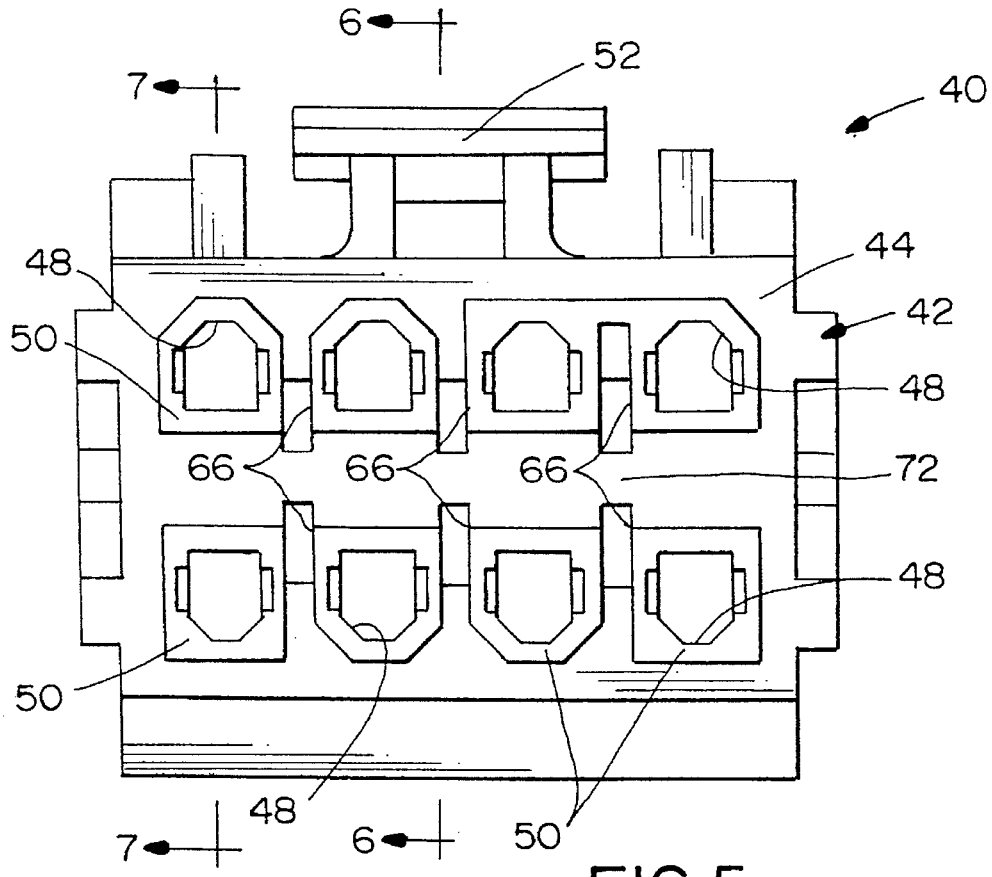
FIG. 5 is a front elevational view of the connector of FIG. 4.

Referring to the drawings in greater detail, and first to FIGS. 1–3, an electrical connector assembly, generally designated 10, is shown to include a terminal position assurance system according to the prior art. The connector includes an elongated housing, generally designated 12, having a front mating face 14 and a rear terminal-insertion face 16, with a plurality of terminal-receiving cavities 18 extending transversely of the housing between the faces. The housing is unitarily molded of dielectric material such as plastic. The cavities extend into and through a plurality of terminal-protective silos 20 projecting forwardly of front mating face 14. A cantilevered latch arm 22 is molded integrally with the housing for latching the connector to a complementary connector (not shown) having receptacles for receiving silos 20.

Cavities 18 are arranged in two rows lengthwise of housing 12 as best seen in FIG. 2. Correspondingly, the silos are arranged in two rows collinear with the cavities. A cross-shaped channel 24 runs longitudinally of housing 12 and intersects both rows of cavities 18 as best seen in FIG. 3. An elongated, cross-shaped terminal position assurance (TPA) device 26 is insertable into channel 24 lengthwise of the housing. The TPA device has latch bosses 28 for cooperating with the housing to hold the device in its fully inserted position. It can be visualized best in FIG. 3 that channel 24 for TPA device 26 intersects a major portion of each cavity 18. Therefore, if any one terminal is incorrectly positioned, it will block channel 24 preventing the TPA device from being inserted into the housing, indicating problems with terminal positioning. Of course, as will be seen hereinafter, the terminals are configured to allow the TPA device to be fully inserted into the housing if all of the terminals are fully inserted into their respective cavities and into silos 20.

A problem with electrical connector assemblies such as connector assembly 10 is in the manufacturability of the connector, namely molding the connector with separable dies. The problem primarily concerns molding housing 12. Basically, the housing is "open" at the front and rear thereof in the direction of terminal-insertion cavities 18. Preferably, the housing could be molded with only a pair of front and rear separable dies. However, because channel 24 runs lengthwise of the housing and because slot 35 is provided to add stability to the cross shaped TPA 26, either the channel must be molded with a separate or third slide die, or the channel must be molded through the front face of the housing. Side slide dies are unacceptable, as pointed out in the "Background", above. The channel cannot be molded completely through the rear face of the housing, because cavities 18 are separated by walls 30 (FIG. 3). Therefore, an elongated opening 32 runs substantially along the entire front face 14 of housing 12 for insertion therethrough, during molding, of a portion of the front die in order to mold elongated channel 24. Notches 34 (FIG. 2) also are molded through the front face of the housing for insertion of portions of the front die for forming the front edges 36 (FIG. 3) of walls 30. As a result, silos 20 end up being unsupported by the housing along the insides of the silos because of the opening 32 running lengthwise of the housing, as best seen in FIG. 2. Consequently, the silos have a tendency to break away from the housing or the entire housing breaks lengthwise thereof along the opening 32.

FIGS. 4–8 show an electrical connector assembly, generally designated 40, incorporating the concepts of the invention and designed to solve the manufacturability problems discussed above in relation to prior art connector 10 in FIGS. 1–3. Again, connector assembly 40 includes an elongated housing, generally designated 42, having a front mating face 44 and a rear terminal-insertion face 46. The housing is unitarily molded of dielectric material such as plastic. A plurality of terminal-receiving cavities 48 extend transversely of housing 42 between faces 44 and 46. A plurality of terminal-protective silos 50 project forwardly of front mating face 44. Like connector 10, cavities 48 and silos 50 are arranged in two rows lengthwise of housing 42. A cantilevered latch arm 52 again is molded integrally with the housing for latching the connector to a complementary mating connector having receptacles for receiving silos 50. A plurality of terminals, generally designated 54, are inserted into cavities 48 through rear terminal-insertion face 46 of the housing.

Figure 6:
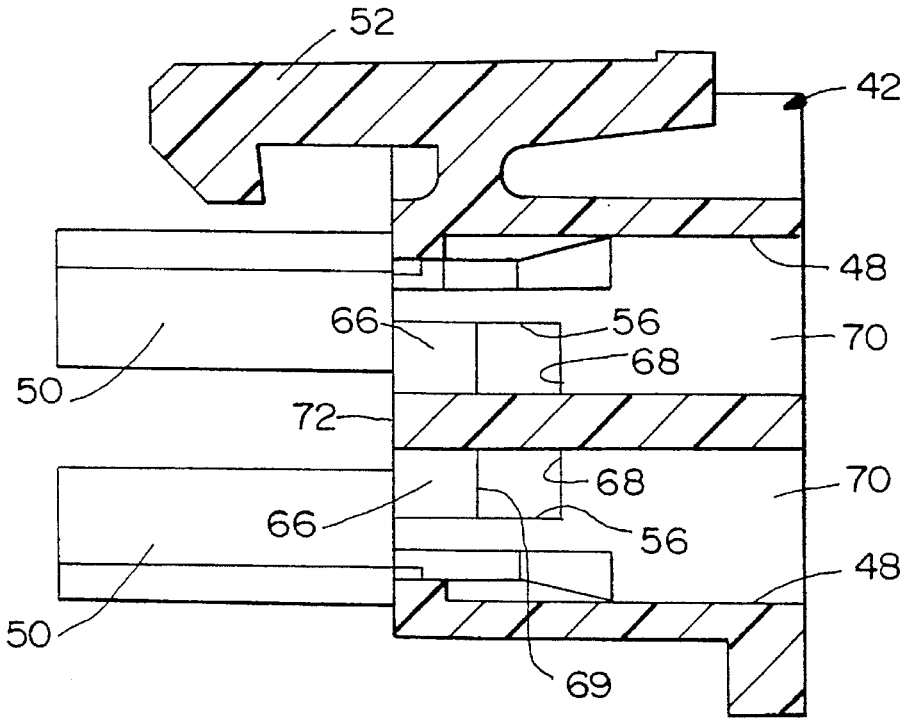
FIG. 6 is a vertical section, taken generally along line 6—6 of FIG. 5.

Two separate and distinct parallel channels 56 run longitudinally of housing 14 intersecting the two rows of cavities 48 as best seen in FIG. 6. These channels 56 are defined by front walls 68, rear walls 69 and top and bottom walls. As seen clearly in FIG. 4, a unitary or one-piece terminal position assurance (TPA) device, generally designated 58, includes a pair of longitudinal legs 60 joined by a bight portion 62. The legs are insertable into channels 56 lengthwise of housing 42, and bight portion 62 acts as a manually grippable handle for the TPA device. A pair of latch bosses 64 are effective to cooperate with housing 42 to latch the TPA device in its fully inserted position.

In order to mold housing 42 by using only two separable front and rear dies, slits 66 are formed in housing 42, during molding, for receiving portions of the front die. The location of the slits between silos 50 are clearly shown in FIG. 5. The slits are a result of the front die passing into walls 70 that separate terminal-receiving cavities 48 in housing 42 forming the front walls 68 and top and bottom walls of the changes 56. The rear die forms the rear walls 69 of cavities 48. Particular reference is made to FIG. 5 wherein it can be seen that a solid longitudinal wall portion 72 of the housing along front mating face 44 is molded between the two rows of silos 50. Therefore, the silos are substantially entirely surrounded by supporting plastic material of the housing at the front mating face thereof, except for the small slits 66 which facilitate molding the front edges of walls 70 at the rear of channels 56. The problems of silo/connector breakage is substantially eliminated by this molding or manufacturing capability afforded by the bifurcated TPA device 58 and the two separate and distinct channels 56.

Figure 7:
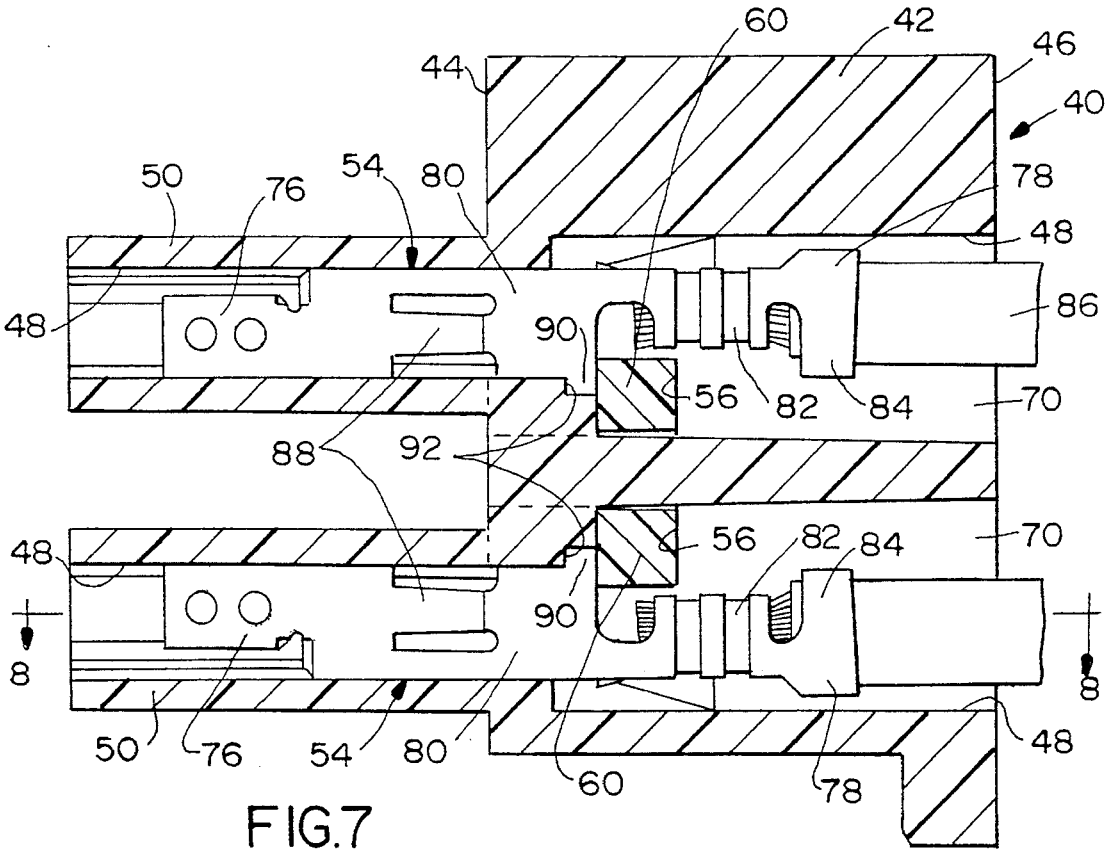
FIG. 7 is a vertical section taken generally along line 7—7 of FIG. 5.
Figure 8:
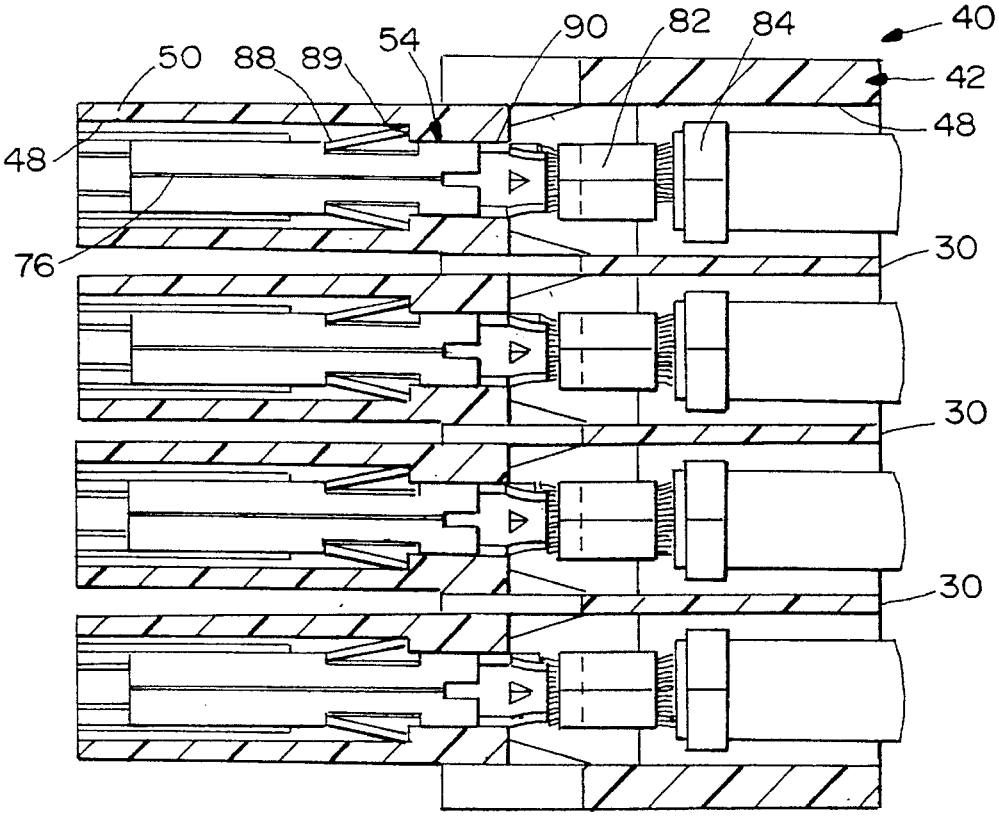
FIG. 8 is a horizontal section taken generally along line 8—8 of FIG. 7.

FIGS. 7 and 8 show a plurality of terminals 54 mounted in respective cavities 48 in housing 42. Each terminal has a front mating portion 76, a rear terminating portion 78 and an intermediate portion 80 therebetween. Front mating portion 76 is in the form of a socket-type female contact for receiving a male contact of the mating connector. Rear terminating end 78 includes two pairs of crimp arms 82 and 84. Crimp arms 82 are located for clamping onto the conductor(s) of an electrical wires 86, and crimp arms 84 are located for clamping onto the outer insulation of the wire. Intermediate portion 80 includes side cantilevered spring latch arms 88 which snap outwardly into locking engagement with latch shoulders 89 (FIG. 8) when the terminal is fully inserted into its respective cavity. The intermediate portion also has outwardly projecting stop tabs 90 (FIG. 7) for abutting against stop shoulders 92 within the cavities to define the fully forward inserted positions of the terminals. Once fully inserted, the terminals cannot be backed out of their cavities by the interengagement of latch arms 88 with shoulders 89.

It can be seen best in FIG. 7 that, when terminals 54 are fully inserted into their respective cavities, channels 56 are clear for receiving legs 60 of TPA device 58. However, if any one terminal in either row thereof is not fully inserted to its respective insertion position within silos 50, either stop tabs 90 or any other portion of the terminal forwardly of the tabs to the front mating portion of the terminal, will at least partially block one of the channels 56 and prevent the TPA device to be extended into the housing. This will indicate a terminal-positioning problem in the connector.

Lastly, FIG. 7 shows how the legs 60 of TPA device 58 act as a second latch means for the terminals of the connector. In particular, when the TPA device is inserted into the housing as shown in FIG. 7, tabs 90 are positioned immediately forwardly of legs 60 of the TPA device. The legs will block any rearward movement of the terminals.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector assembly which includes a terminal position assurance system, comprising:

an elongated housing having a front mating face and a rear terminal-insertion face with a plurality of terminal-receiving cavities extending transversely of the housing between the faces, the cavities being arranged in two rows lengthwise of the housing and including two rows of terminal-protective silos projecting forwardly of the front mating face in alignment with the cavities, transverse walls between the cavities in each row extending in a direction between the faces, two generally parallel channels longitudinally of the housing intersecting the two rows of cavities, a longitudinal solid wall portion of the front mating face extending lengthwise between the two rows of forwardly projecting silos and further extending between the front mating face and the rear terminal-insertion face, and a plurality of slits in the front mating face between the adjacent silos in alignment with the transverse walls and extending rearwardly to the channels;

a plurality of terminals adapted to be inserted into the cavities to fully inserted positions in the forwardly projecting silos, the terminals having portions adapted to block said channels if the terminals are not in their said respective fully inserted positions; and an elongated bifurcated terminal position assurance device including a pair of longitudinal legs insertable into the two channels each leg having a wall facing a wall of opposite leg, each facing wall located adjacent a respective opposite surface of the longitudinal solid wall portion, unless one of the channels is blocked by a portion of one of the terminals in either row thereof;

wherein the front mating face has strength necessary to prevent the silos breaking away from the front mating face when transverse forces are exerted on the silos.

2. The electrical connector of claim 1 wherein the housing and the terminals have complementary interengaging primary latch means to prevent the terminals from backing out of their fully inserted positions, and the terminals and the terminal position assurance device have complementary interengaging secondary latch means to prevent the terminals from backing out of their fully inserted positions when the terminal position assurance device is fully extended into the channels.

3. The electrical connector of claim 1 wherein said terminal position assurance device is a generally U-shaped, one-piece component with the legs of the U-shape defining said pair of longitudinal legs insertable into the two channels.

* * * * *